US008807865B1

(12) United States Patent
Modrono

(10) Patent No.: US 8,807,865 B1
(45) Date of Patent: Aug. 19, 2014

(54) LIGHT WEIGHT LOAD-BEARING PLATFORM

(71) Applicant: Easy Grass, LLC, Miami, FL (US)

(72) Inventor: Manuel A. Modrono, Miami, FL (US)

(73) Assignee: Easy Grass, LLC, Miami, FL (US)

( * ) Notice: Subject to any disclaimer, the term of this patent is extended or adjusted under 35 U.S.C. 154(b) by 0 days.

(21) Appl. No.: 13/838,798

(22) Filed: Mar. 15, 2013

(51) Int. Cl.
*E01C 5/00* (2006.01)
*E01C 13/06* (2006.01)

(52) U.S. Cl.
CPC ..... *E01C 5/005* (2013.01); *E01C 13/065* (2013.01)
USPC ..... 404/34; 404/27; 404/29; 404/31; 404/36; 404/40

(58) Field of Classification Search
CPC ..... E01C 13/065; E01C 5/005
USPC ..... 404/2, 27–29, 31, 34, 37–41
See application file for complete search history.

(56) References Cited

U.S. PATENT DOCUMENTS

| | | | | | |
|---|---|---|---|---|---|
| 3,802,144 | A * | 4/1974 | Spica | 52/591.2 |
| 3,960,375 | A * | 6/1976 | Bibi-Roubi et al. | 472/92 |
| 4,584,221 | A * | 4/1986 | Kung | 428/44 |
| 4,671,699 | A * | 6/1987 | Roach | 404/41 |
| 4,963,054 | A * | 10/1990 | Hayashi | 404/34 |
| 5,250,340 | A * | 10/1993 | Bohnhoff | 428/99 |
| 6,467,224 | B1 * | 10/2002 | Bertolini | 52/177 |
| 6,579,038 | B1 * | 6/2003 | McAllister et al. | 405/16 |
| 7,344,334 | B2 * | 3/2008 | Thorkelson | 404/29 |
| 7,404,689 | B1 * | 7/2008 | Poling | 404/31 |
| 7,571,572 | B2 * | 8/2009 | Moller, Jr. | 52/177 |
| 7,757,449 | B2 * | 7/2010 | Portoles Ibanez et al. | 52/384 |
| 7,918,057 | B2 * | 4/2011 | Moller, Jr. | 52/177 |
| 7,930,865 | B2 * | 4/2011 | Barlow | 52/741.11 |
| 7,950,191 | B2 * | 5/2011 | Brouwers | 52/180 |
| 8,166,722 | B2 * | 5/2012 | Moller, Jr. | 52/588.1 |
| 2006/0285920 | A1 * | 12/2006 | Gettig et al. | 404/31 |
| 2009/0274513 | A1 * | 11/2009 | Scheiwiller | 404/41 |
| 2012/0163911 | A1 * | 6/2012 | Culleton et al. | 404/41 |

* cited by examiner

*Primary Examiner* — Raymond W Addie
(74) *Attorney, Agent, or Firm* — Robinson IP Law, PLLC

(57) ABSTRACT

A lightweight polymer-based load bearing platform preferably including artificial turf for use as a synthetic turf block for easy installation, easy maintenance, and long term durability.

16 Claims, 11 Drawing Sheets

LIGHT WEIGHT LOAD-BEARING PLATFORM

STATEMENT REGARDING NOTICE OF COPYRIGHT

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

FIELD

This disclosure relates to the field of paving and ground cover. More particularly, this disclosure relates to turf blocks for use as a form of pavement or groundcover.

BACKGROUND

Turf blocks or grass blocks are an environmentally preferable alternative to asphalt, full concrete pavement, or dirt for driveways, roadways, sidewalks and the like because these structures allow precipitation moisture to flow directly to the sub terrain and not create storm water runoff. Turf blocks are traditionally thought of as a repeating network of concrete squares (or diamonds) wherein the central section of the squares are hollow and filled with dirt and grass for a quasi-natural terrain wherein the natural portions are supported a kept from being compacted because of the support of surrounding concrete structure.

More recently, alternatives to concrete have been used to create turf block pavement. Nonetheless, although the grass sections are not overly compacted, the grass itself often dies or otherwise changes color due to seasonal stresses or death of the grass itself. Another drawback with many turf block applications is unevenness that develops over time due to the weight of vehicle or foot traffic on such materials.

What is needed, therefore, is an environmentally-friendly, lightweight, and cost-effective structure that accomplishes the functional purposes of traditional turf blocks while maintaining the aesthetic purposes of such turf blocks.

SUMMARY

The above and other needs are met by a lightweight load-bearing platform including a unitary polymeric base structure including at least a first sidewall, a second sidewall, a third sidewall, a fourth sidewall, a top plate, and a plurality of interior wall structures providing support under the top plate; a plurality of indentations along the top plate, an upper surface of each indentation defining an engagement surface, the engagement surface defining an area of A cm2; a plurality of apertures wherein at least one respective aperture is located through each one respective indentation; a first male attachment device located along an outer surface of the first sidewall; a second male attachment device located along an outer surface of the second sidewall; a first female attachment device located along an outer surface of the third sidewall; and a second female attachment device located along an outer surface of the fourth sidewall. The load-bearing platform may further include at least five full engagement surfaces, each full engagement surface defining the area of approximately A $cm^2$; and at least four half engagement surfaces, each half engagement surface defining an area of approximately (0.5)

·A $cm^2$. In some cases, the at least five full engagement surfaces comprise approximately identical shapes. In some cases, five separate sections of artificial turf are attached to each of the at least five full engagement surfaces, wherein the sections of artificial turf do not extend beyond the edge or edges of the respective full engagement surfaces. In some cases, the at least five full engagement surfaces include square shapes and the outer edges of the engagement surfaces are oriented substantially parallel to each other, thereby defining a crisscross pattern of bar shaped sections along the top plate.

In cases in which five separate sections of artificial turf are attached to each of the at least five full engagement surfaces, in certain situations, artificial turf does not extend beyond the edge or edges of the respective full engagement surfaces.

Load-bearing platforms as described above may further include at least four quarter engagement surfaces, each quarter engagement surface defining an area of approximately (0.25)·A $cm^2$, and wherein the edges of the top plate define a substantially square shape.

In some cases, the plurality of interior wall structures further include a plurality of channels defined by channel wall structures oriented orthogonally from a lower surface of the top plate, wherein each channel wall structure extends from a respective area along the lower surface of the top plate within which one of the respective apertures is located, thereby providing a path for fluid to migrate from the upper surfaces of the indentations to locations below the load-bearing platform. In certain cases, the channels are formed in a cylindrical shape. In some cases, the first sidewall, the second sidewall, the third sidewall, and the fourth sidewall each further include six substantially planar sub-wall portions, and each adjacent pair of sub-wall portions are oriented at an interior angle ranging from about 135 degrees to about 270 degrees. In these situations, the plurality of interior wall structures can further include at least four branch walls extending at approximately 0 degrees, 90 degrees, 180 degrees, and 270 degrees from each of the channel wall structures and extending to adjacent channel wall structures. Also, the plurality of interior wall structures can further include at least eight branch walls extending at approximately 0 degrees, 45 degrees, 90 degrees, 135 degrees, 180 degrees, 225 degrees, 270 degrees and 315 degrees from at least one of the channel wall structures and, in such cases, the branch wall structures extending at approximately 45 degrees, 135 degrees, 225 degrees, and 315 degrees from the channel wall structures all can extend all the way to adjacent channel wall structures.

In some situations, a support pad including a base and a groove defined between a pair of pad sections is included, wherein the pad is removably attached along one of the interior wall structures. The groove is preferably defined orthogonal to the base whereby the pad can be removably engaged along the bottom of a load bearing platform by pressing a first side of the pad that includes the groove against an interior wall structure of the load-bearing platform such that the interior wall is jammed between the pair of pad sections.

In certain cases, the first female attachment device described above further includes an elongate slot extending from a bottom edge of the third sidewall to from about 20% to about 80% the height of the third sidewall.

In certain situations, the first female attachment device described above further includes a vertically oriented narrow appendage including a cap extending orthogonal from a distal end of the appendage, wherein the appendage extends outward from a bottom edge of the first sidewall to from about 20% to about 80% the height of the first sidewall.

In certain situations, the upper surfaces of the bar shaped sections described above have the appearance of a surface including, for example, concrete, brick, rock, or sand.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

About: indicates a range of variation of a given value of up to 5% of the given value.

Approximately: indicates a range of variation of a given value of up to 5% of the given value.

Substantially: indicates a range of variation of a given value of up to 2% of the given value.

Figure 1:
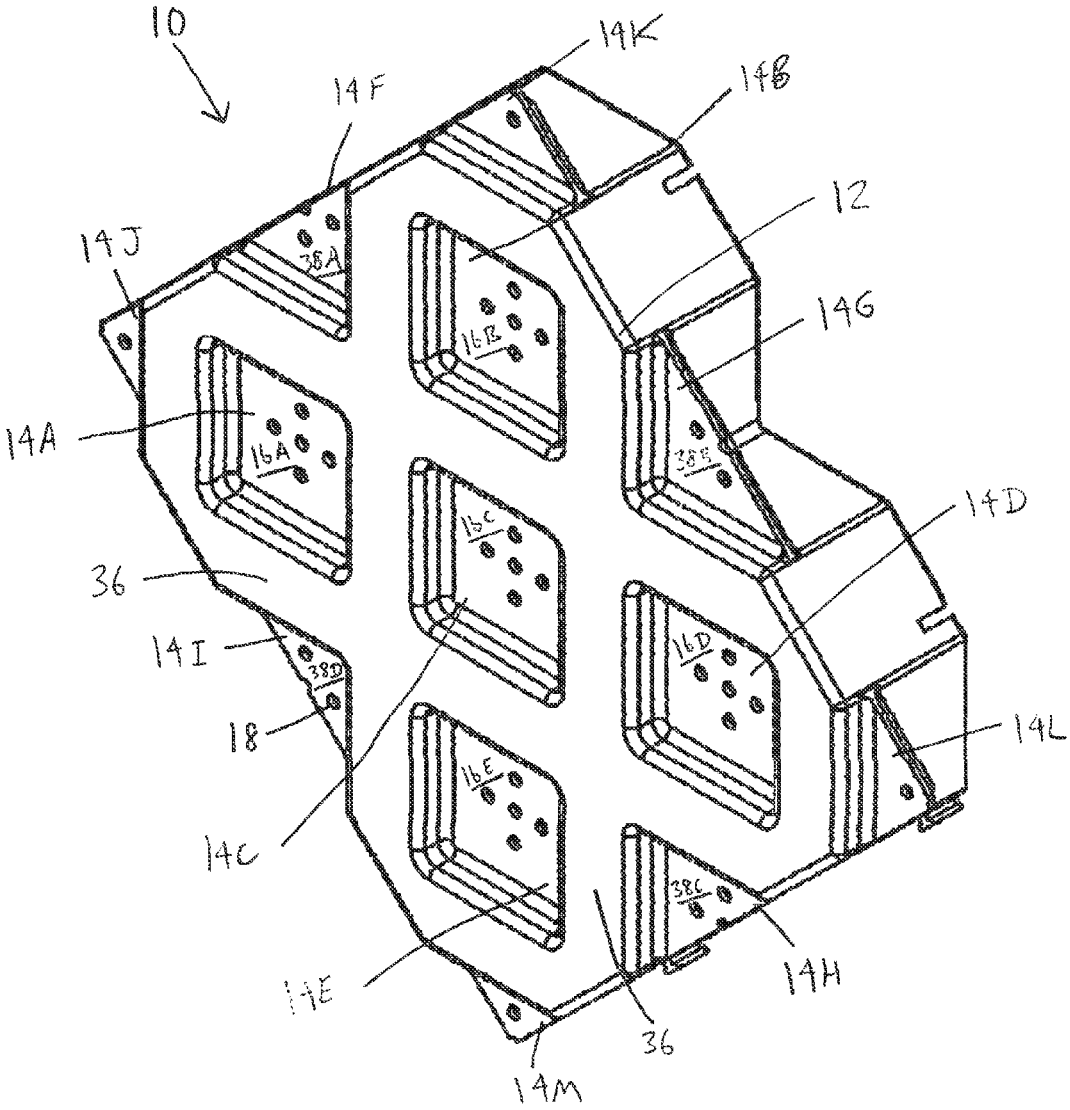
FIG. 1 shows a top perspective view of a load-bearing platform.
Figure 2:
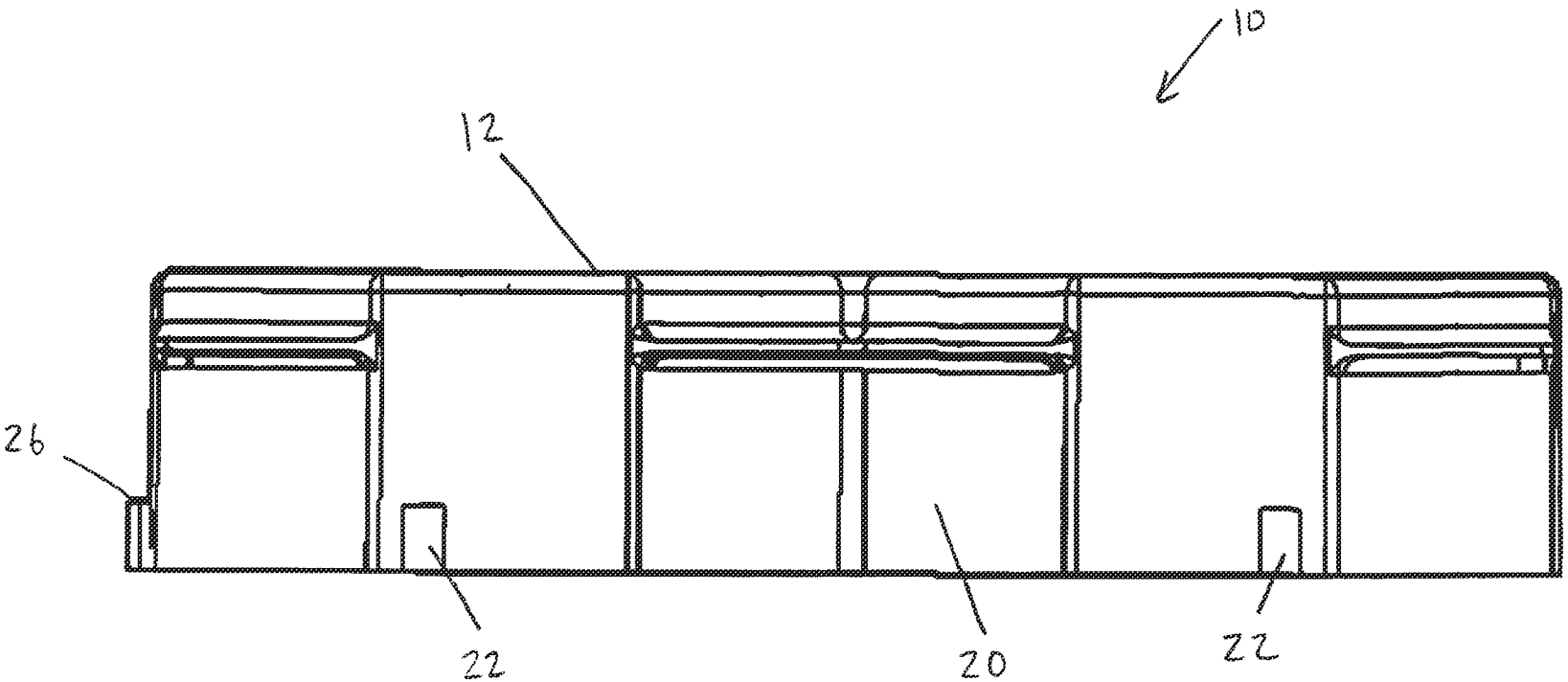
FIG. 2 shows a first side view of the load-bearing platform of FIG. 1.
Figure 3:
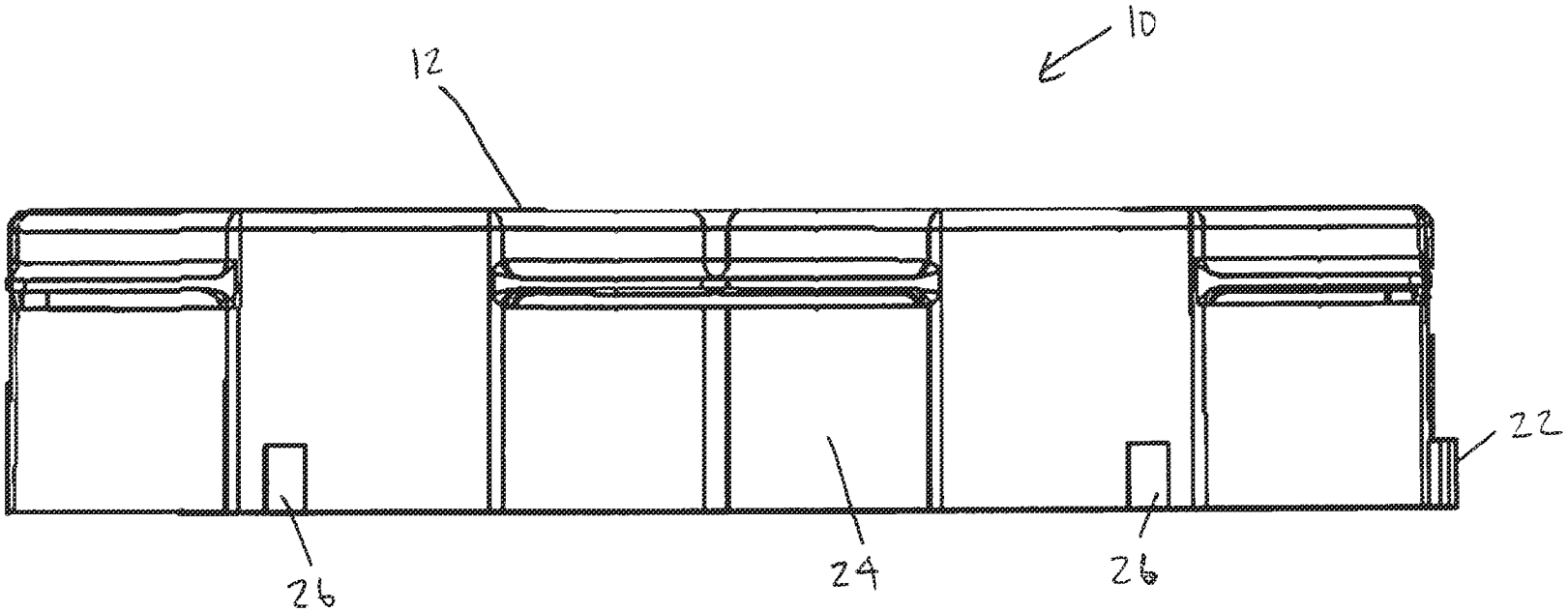
FIG. 3 shows a second side view of the load-bearing platform of FIG. 1.
Figure 4:
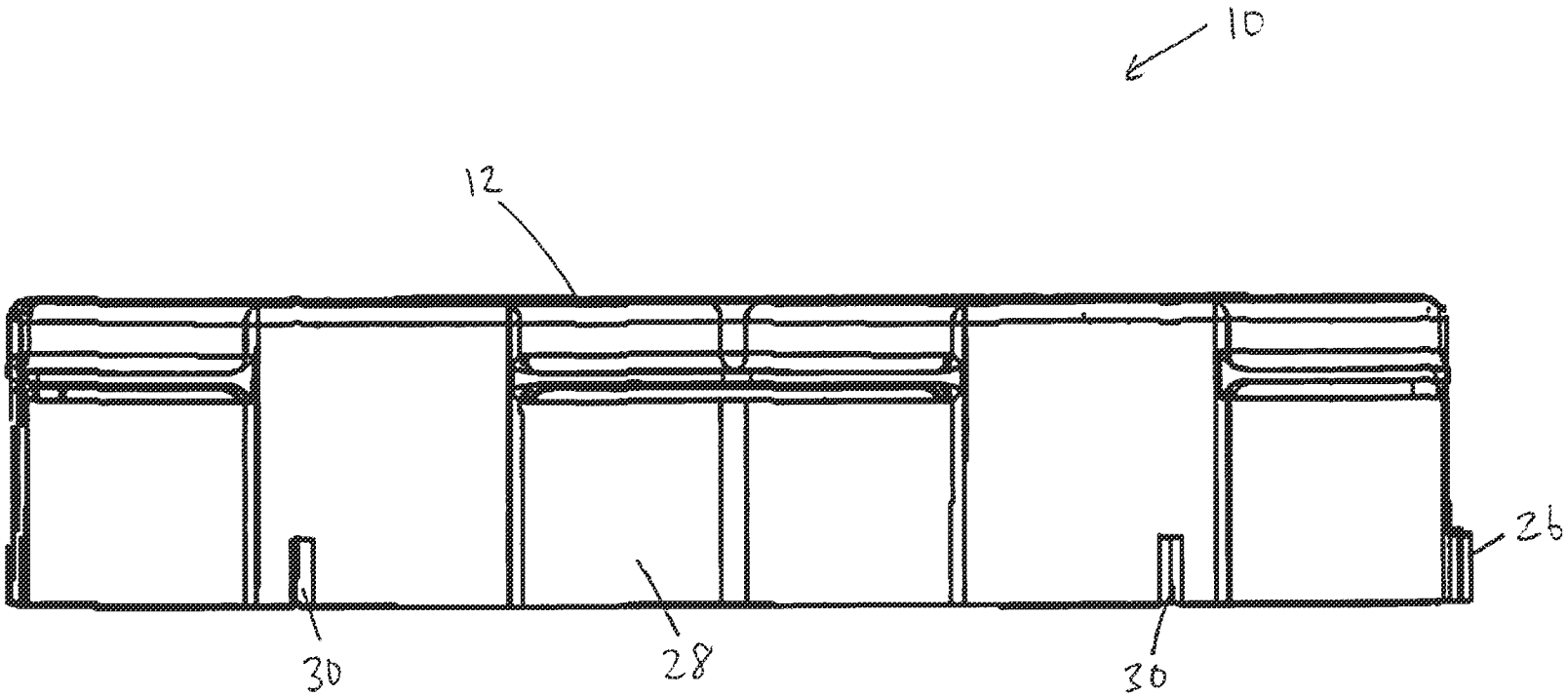
FIG. 4 shows a third side view of the load-bearing platform of FIG. 1.
Figure 5:
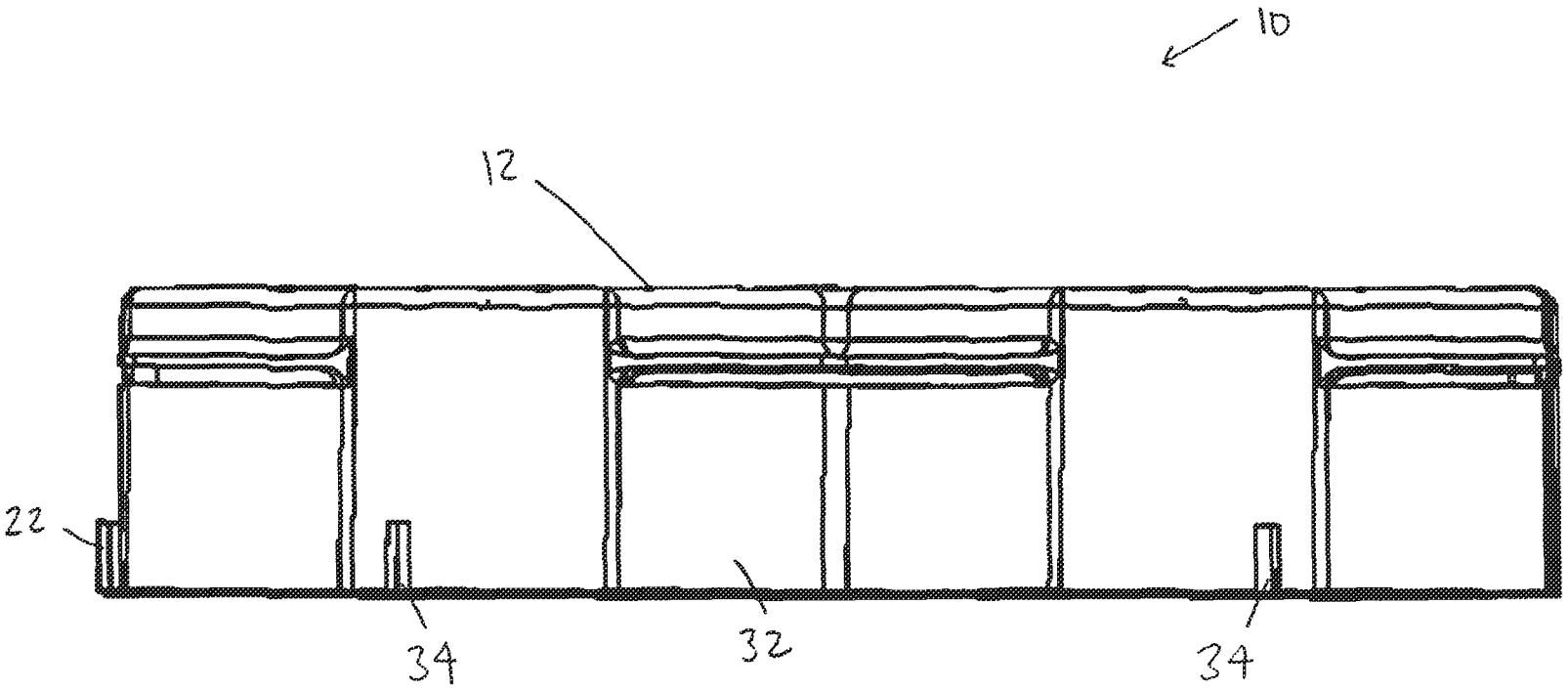
FIG. 5 shows a fourth side view of the load-bearing platform of FIG. 1.

FIG. 1 shows a perspective view of an example of a lightweight load-bearing platform 10 as described herein. The load-bearing platform 10 includes a top plate 12 which includes a plurality of indentations 14A-14M. Each of the indentations 14 defines an engagement surface 16A-16M. Each indentation 14 includes at least one aperture 18 located therethrough. FIG. 2 shows a first side view of the load-bearing platform 10 showing a first sidewall 20 including a first male fastener 22. FIG. 3 shows a second side view of the load-bearing platform 10 showing a second sidewall 24 including a second male fastener 26. FIG. 4 shows a third side view of the load-bearing platform 10 showing a third sidewall 28 including a first female fastener 30. Similarly, FIG. 5 shows a fourth side view of the load-bearing platform 10 showing a fourth sidewall 32 including a second female fastener 34.

Figure 6:
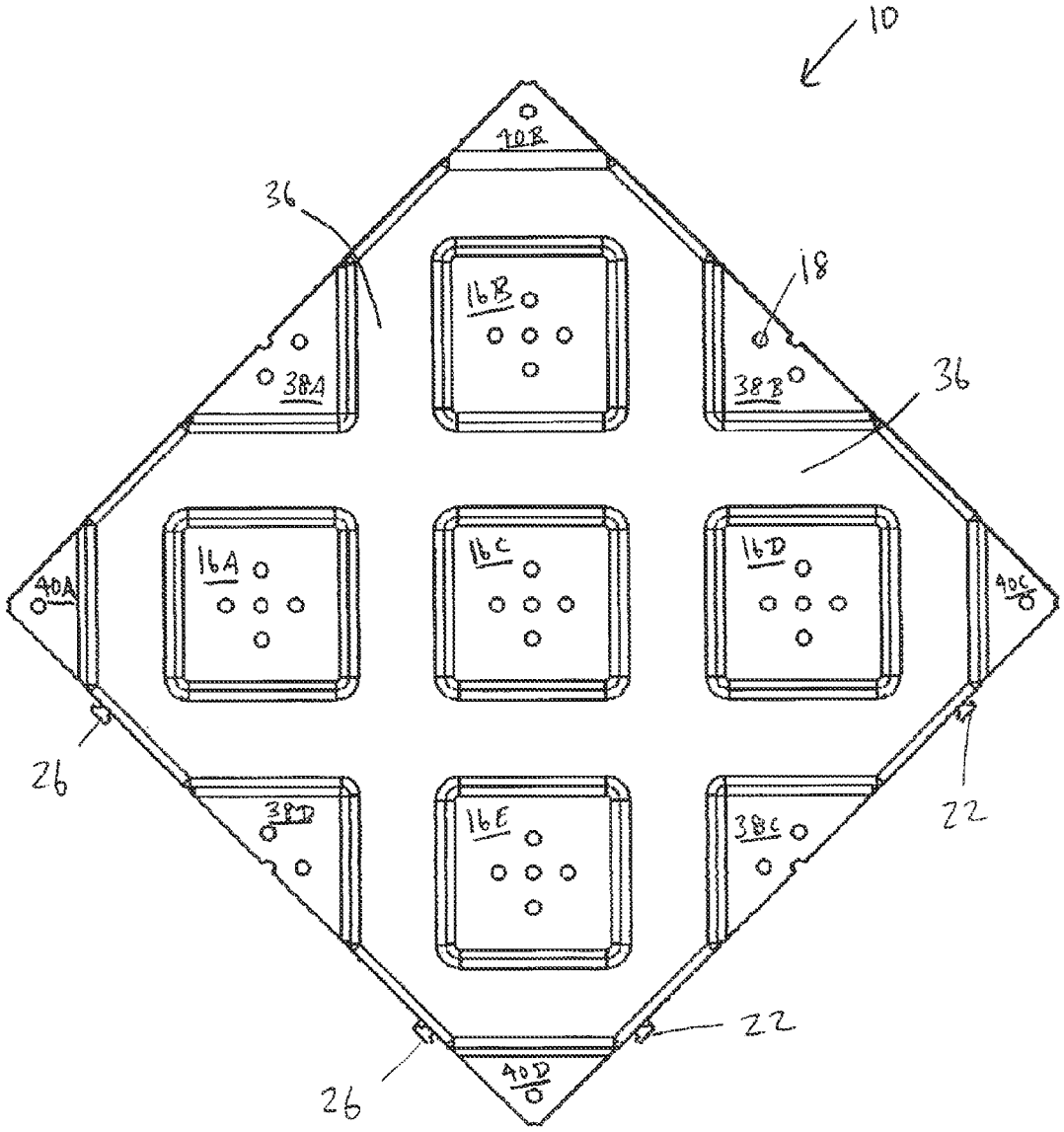
FIG. 6 shows a top plan view of the load-bearing platform of FIG. 1.

FIG. 6 shows a top plan view of the load-bearing platform 10, giving a clearer view of an example of a preferred geometric pattern of indentations 14 along the top plate 12. The top plate 12 shown in FIG. 6 includes five full engagement surfaces 16A-16E, each defining an area of from about 80 $cm^2$ to about 100 $cm^2$, and more preferably from about 85 $cm^2$ to about 95 $cm^2$. Preferably, the engagement surfaces have substantially the same shape and such shapes are preferably substantially aligned with one another in a regular repeating pattern to give the appearance of traditional square or diamond turf blocks, although other shapes and configurations are contemplated herein. Sections of artificial turf are preferably attached to the engagement surfaces 16 wherein such sections of artificial turf are preferably sized and shaped to fit adjacent to each engagement surface 16 without overlapping the edges of each engagement surface 16. The example shown in FIG. 1 shows a crisscross pattern of bar-shaped sections 36 along the top plate between the indentations 14. The bar-shaped sections 36 resemble the traditional concrete used in traditional turf block applications.

Figure 7:
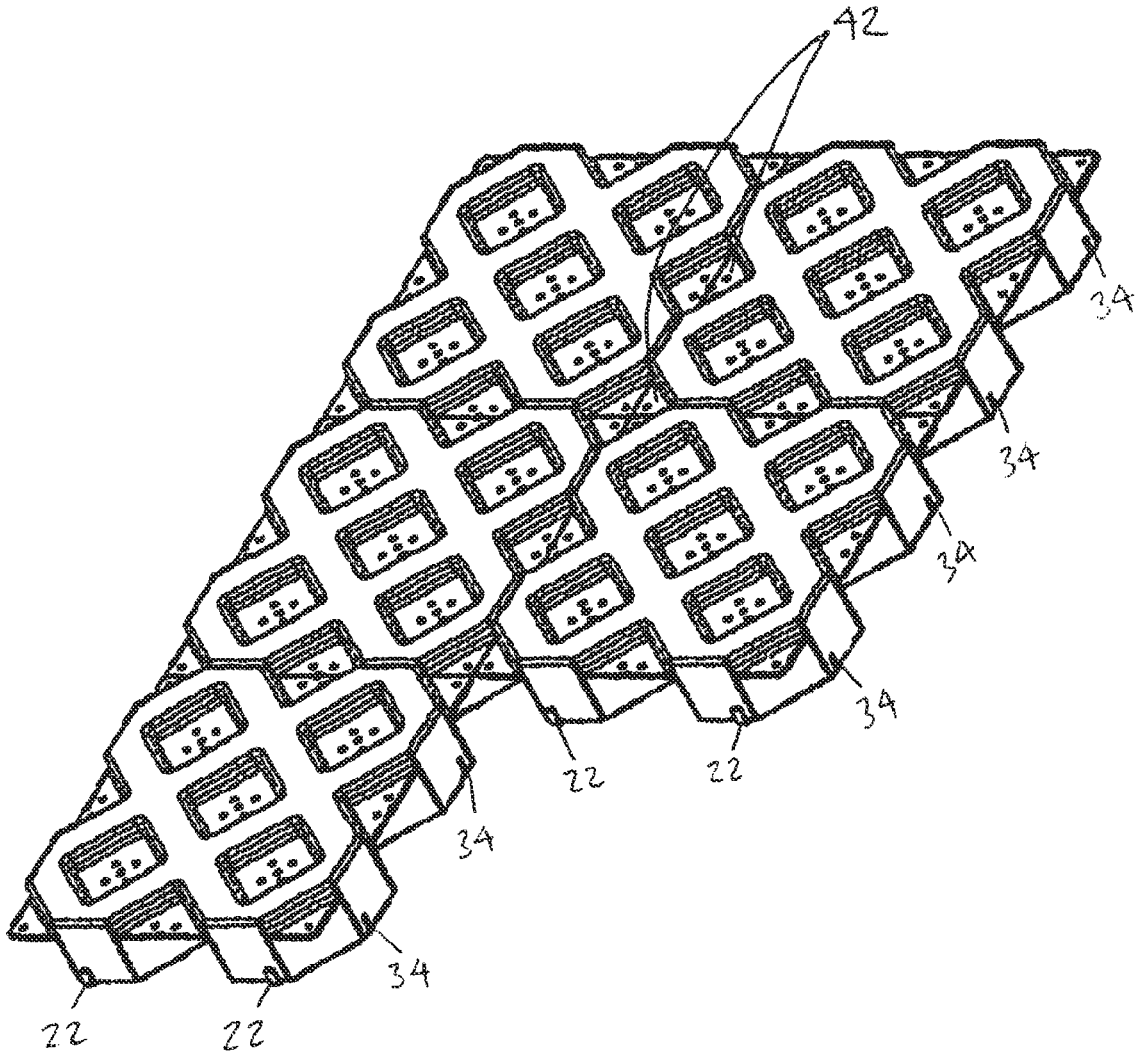
FIG. 7 shows a top perspective view of a plurality of load-bearing platforms of FIG. 1 removably attached together.
Figure 8:
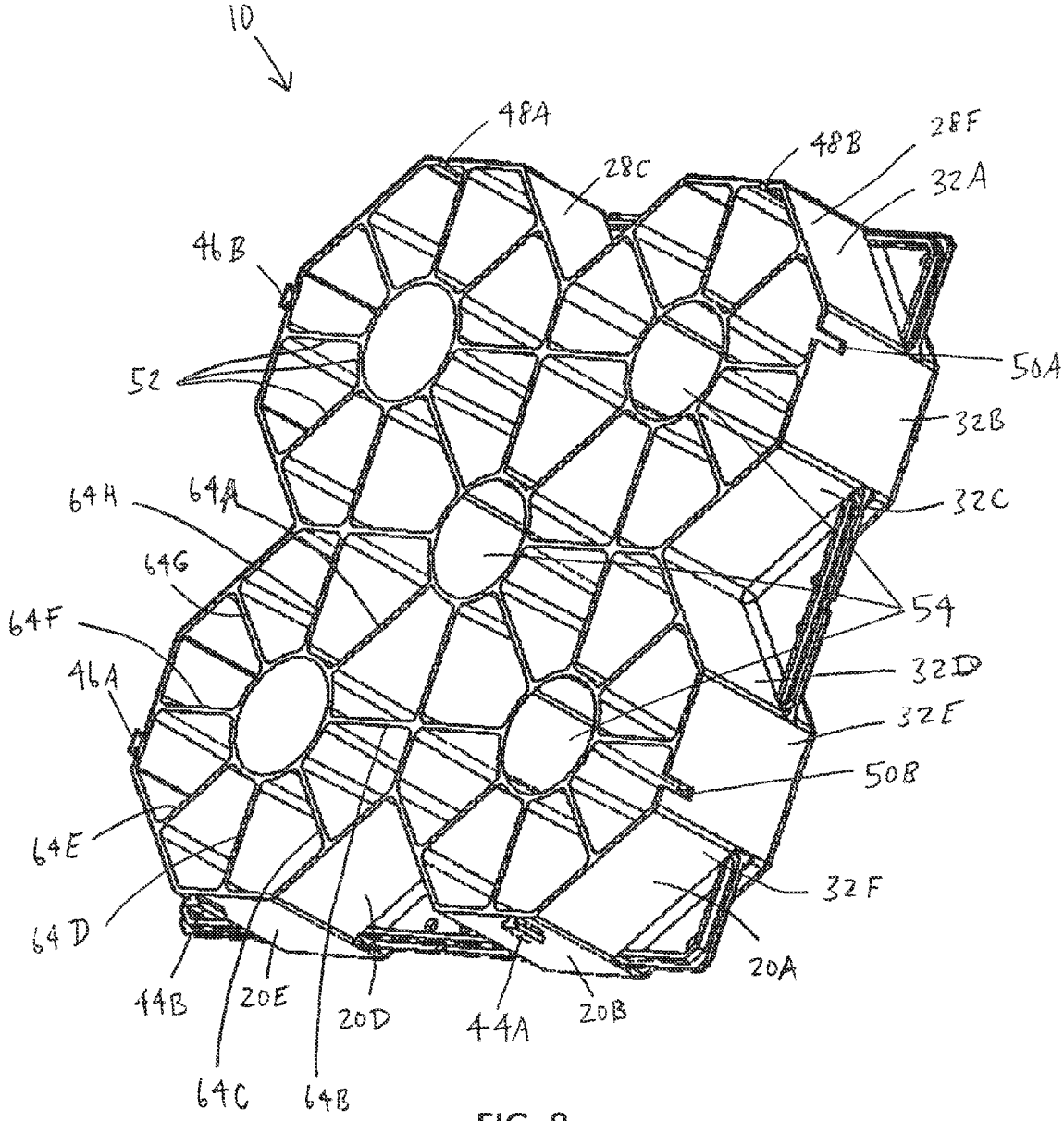
FIG. 8 shows a bottom perspective view of the load-bearing platform of FIG. 1.
Figure 9:
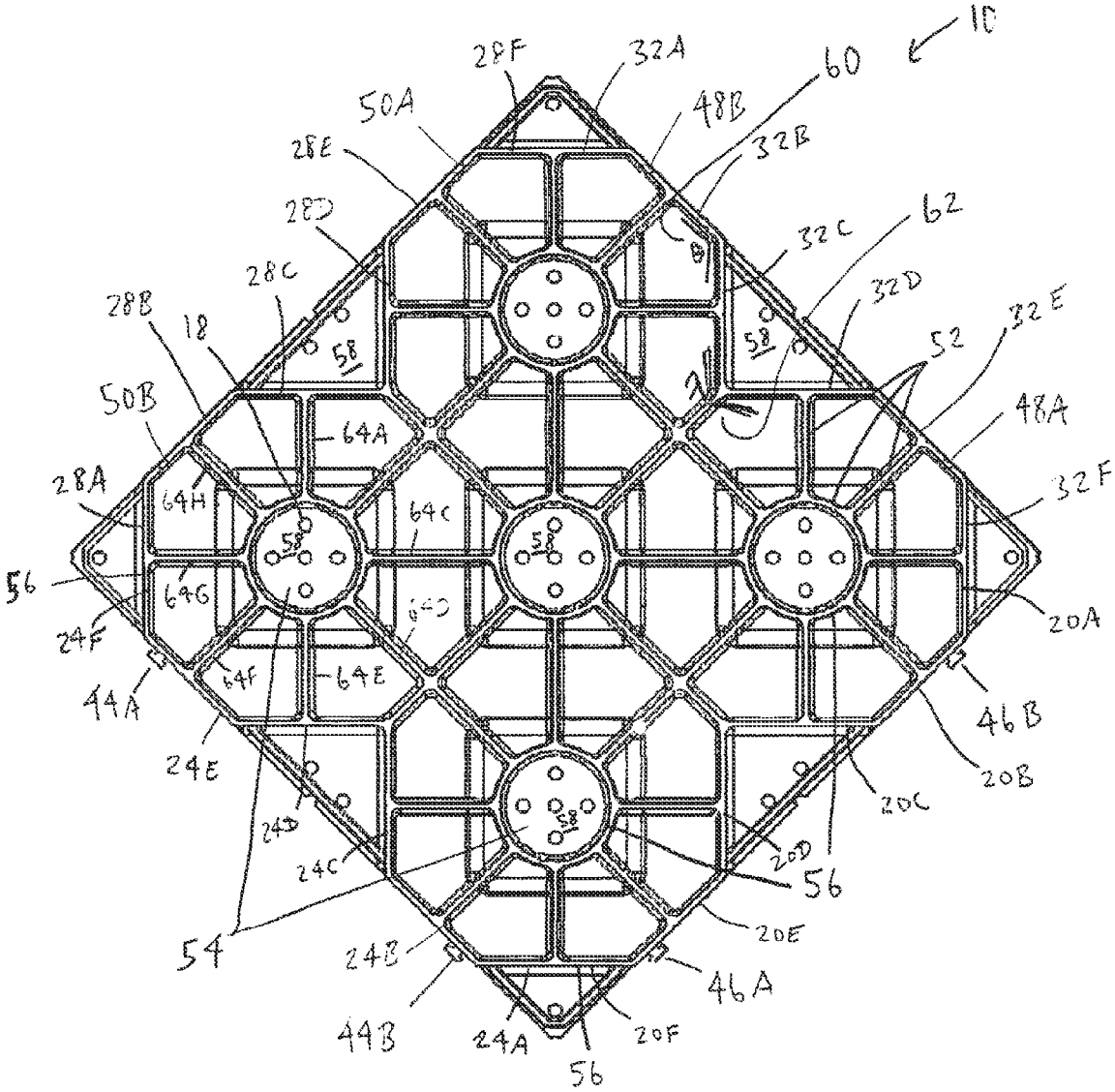
FIG. 9 shows a bottom plan view of the load-bearing platform of FIG. 1.

The top plate 12 shown in FIG. 6 also includes four half engagement surfaces 38A-38D and four quarter engagement surfaces 40A-40D. When multiple load-bearing platforms 10 are to attached together as shown in FIG. 7, the half engagement surfaces 38 and the quarter engagement surfaces 40 come together to form full engagement surfaces 42. In this way, the pattern provided on the top plate 12 can be repeated as many times as necessary depending on the size of the area to be covered by the load-bearing platforms 10. The load-bearing platforms engage with one another via the first male fastener 22, the second male fastener 26, the first female fastener 30, and the second female fastener 34 wherein a male fastener slides into or otherwise attaches to an adjacent female fastener as shown in FIG. 7, FIG. 8, and FIG. 9. In the example shown in FIGS. 1-9, the first male fastener 22 includes two hitches 44A and 44B, the second male fastener 26 includes two hitches 46A and 46B, the first female fastener 30 includes two notches 48A and 48B, and the second female fastener 34 includes two notches 50A and 50B.

FIG. 8 and FIG. 9 show a bottom view of the load-bearing platform 10 including a plurality of interior wall structures 52. The interior wall structures 52 include a plurality of channels 54 defined by channel wall structures 56 oriented orthogonally from a lower surface 58 of the top plate 12, wherein each channel wall structure 56 extends from a respective area along the lower surface 58 of the top plate 12 within which one of the respective apertures 18 is located. The channels 54 allow for fluid that temporarily accumulates along the indentations 14 to escape through the apertures 18 and down through the channels 54 to a space beneath the load-bearing platform 10, thereby providing similar functionality as that of a traditional concrete turf block including grass and soil.

The first sidewall 20, the second sidewall 24, the third sidewall 28, and the fourth sidewall 32 each further include six substantially planar sub-wall portions including sub-wall portions 20A-20F, sub-wall portions 24A-24F, sub-wall portions 28A-28F, and sub-wall portions 32A-32F wherein sub-wall portions 20A and 32F are one in the same, sub-wall portions 20F and 24A are one in the same, sub-wall portions 24F and 28A are one in the same, and sub-wall portions 28F and 32A are one in the same. In the embodiment shown in FIG. 8, each adjacent pair of sub-wall portions are oriented at an interior angle ranging from about 135 degrees to about 270 degrees as shown, for example, by angle θ 60 and angle λ 62. The interior wall structures 52 also include branch walls 64 extending at approximately 0 degrees (64A), 45 degrees (64B), 90 degrees (64C), 135 degrees (64D), 180 degrees (64E), 225 degrees (64F), 270 degrees (64G) and 315 degrees (64H) from each of the channel wall structures 56. Branch wall 64A, branch wall 64C, branch wall 64E, and branch wall 64G all extend directly to adjacent channel wall structures 56.

Figure 10:
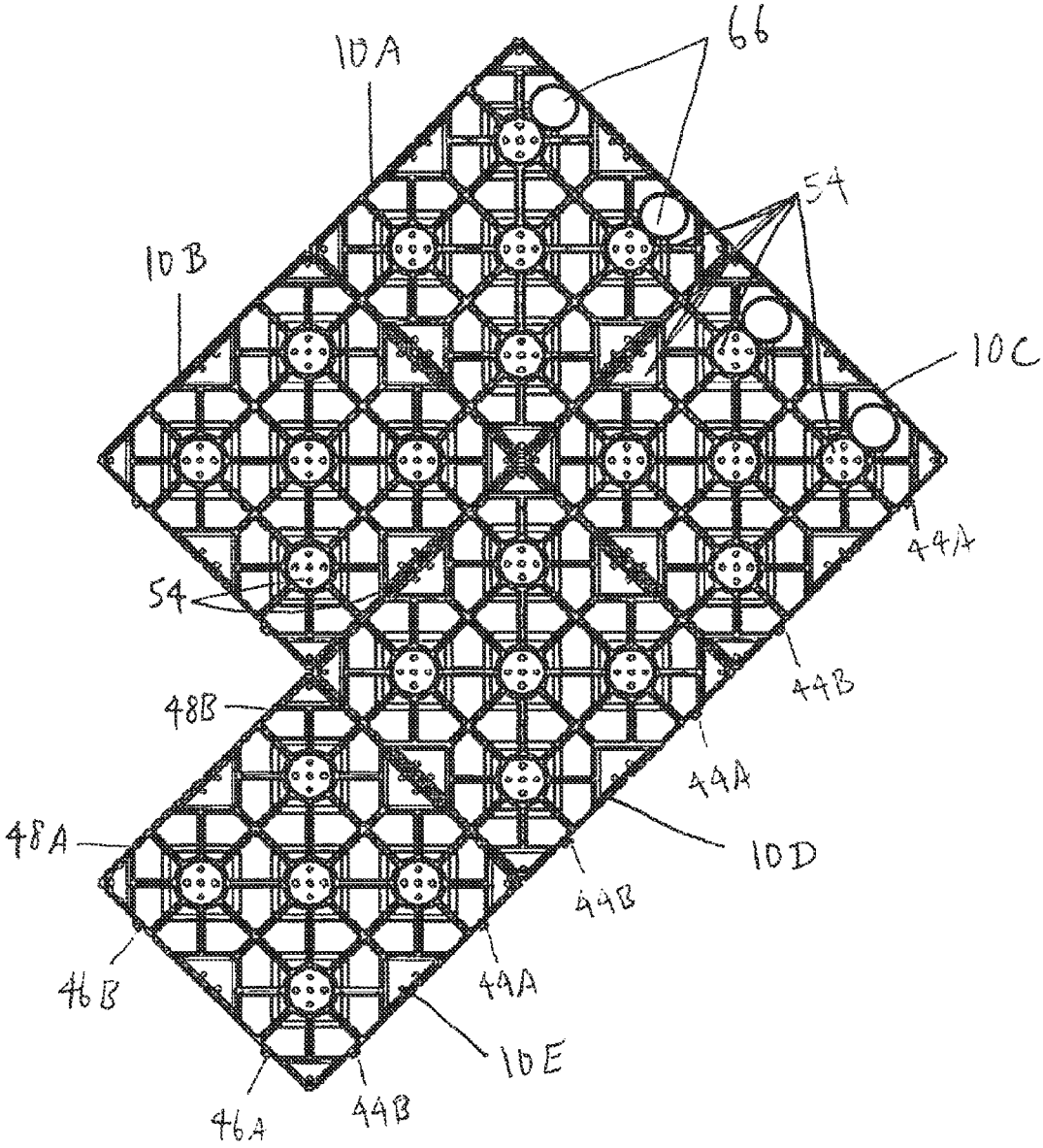
FIG. 10 shows a bottom plan view of a plurality of load-bearing platforms of FIG. 1 removably attached together including a plurality of pads attached along the bottoms of some of the load bearing platforms.
Figure 11:
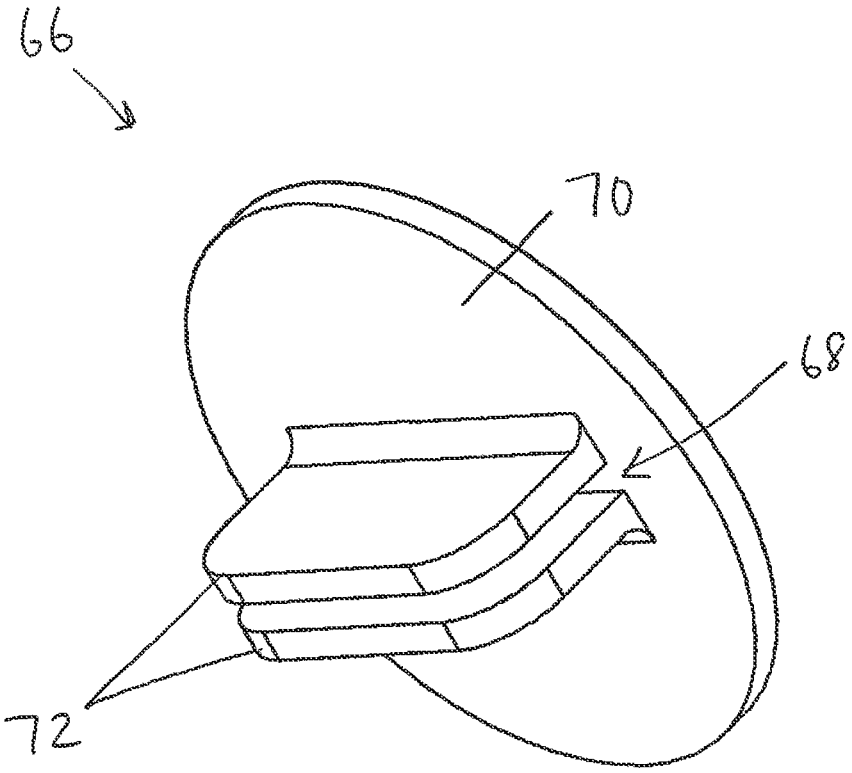
FIG. 11 shows an example of a pad as shown in FIG. 10.

FIG. 10 shows a bottom view of a plurality of load bearing platforms 10A-10E fastened to one another. A plurality of pads 66 are shown attached to interior wall structures 52. Each pad 66, as shown in FIG. 11, preferably includes a groove 68 defined orthogonal to a base 70 (preferably a planar-shaped member) so that the pads can be removably engaged along the bottom of a load bearing platform by pressing the groove 68 side of a pad 66 against an interior wall structure 52 such that an interior wall 52 is jammed between a pair of pad sections 72 oriented substantially orthogonal to the base 70, defining the groove 68. The pads 66 help distribute force exerted against the load bearing platform 10 down to the planar members 70. The pads 66 also help hold groups of joined load bearing platforms to remain stationary relative to any surface on which such load bearing platforms are laid. The pads 66 are preferably made by molding techniques such as blow molding, and are preferably made of a composition primarily including polymers, co-polymers, or polymer blends including, for example, polyvinyl chloride, polyethylene, polypropylene or combinations thereof.

The sidewalls (20, 24, 28, 32) and interior wall structures 52 provide support for the top plate 12, preferably providing a compressive strength ranging from about 10 megapascals (MPa) to about 80 MPa or greater for the load-bearing platform. This level of compressive strength allows for a set of attached load-bearing platforms 10 to support automobiles and similarly weighted materials without substantial deformation. The load-bearing platforms 10 can also be used in other pavement type applications such as, for example, walkways, gardens, outdoor play areas, and any area that is prone to soil compression and the accumulation of fluid from runoff and/or direct precipitation.

The load-bearing platforms 10 are preferably manufactured by blow-molding or other molding techniques, and are made of a composition primarily including polymers, co-polymers, or polymer blends including, for example, high density polyethylene, polypropylene, or combinations thereof.

Finished artificial turf sections can be attached to the engagement surfaces 16 during to manufacturing using, for example, an adhesive. Additional artificial turf sections can then be provided for a contractor, retail customer, or other end user to attach to the engagement surfaces 42 after a plurality of load-bearing platforms 10 have been attached together and laid in place. Alternatively, a contractor, retail customer, or other end user can select from a variety of colors and styles of artificial turf sections to attach to a load-bearing platform 10. Additionally, the bar-shaped sections 36 can include a surface texture and/or coloration resembling concrete, brick, rock, sand, or other similar materials based on using different manufacturing molds and altering dyes used to formulate the underlying polymeric composition.

The previously described embodiments of the present disclosure have many advantages, including maintaining the aesthetic features and functionality (minimize pavement compression, maximize fluid flow to subsurface levels) of traditional forms of turf blocks while providing a significantly lighter, easily recyclable product that is much easier to maintain, alter, manipulate and/or remove if needed. For example, instead of carefully placing five concrete blocks in place, filling them with soil and grass, and then maintaining the grass, a person can simply lay a single load-bearing platform 10 as shown in FIG. 1 and accomplish the same work. Moreover, the load-bearing platforms 10 are readily attachable to and detachable from one another.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A lightweight load-bearing platform comprising:

a. a unitary polymeric base structure including at least a first sidewall, a second sidewall, a third sidewall, a fourth sidewall, a top plate, and a plurality of interior wall structures providing support under the top plate;

b. the top plate including a plurality of indentations, an upper surface of each indentation defining an engagement surface, the engagement surface defining an area of A $cm^2$;

c. a section of artificial turf secured to at least one of the engagement surfaces of the plurality of indentations;

d. a plurality of apertures wherein at least one respective aperture is located through each one respective indentation of the top plate;

e. a first male attachment device located along an outer surface of the first sidewall;

f. a second male attachment device located along an outer surface of the second sidewall;

g. a first female attachment device located along an outer surface of the third sidewall; and h. a second female attachment device located along an outer surface of the fourth sidewall.

2. The load-bearing platform of claim 1 further comprising at least five full engagement surfaces, each full engagement surface defining the area of approximately A $cm^2$; and at least four half engagement surfaces, each half engagement surface defining an area of approximately $(0.5)\cdot A\ cm^2$.

3. The load-bearing platform of claim 2 wherein the at least five full engagement surfaces comprise approximately identical shapes.

4. The load-bearing platform of claim 2 wherein five separate sections of artificial turf are attached to each of the at least five full engagement surfaces, wherein the sections of artificial turf do not extend beyond the edge or edges of the respective full engagement surfaces.

5. The load-bearing platform of claim 3 wherein five separate sections of artificial turf are attached to each of the at least five full engagement surfaces, and wherein the sections of artificial turf do not extend beyond the edge or edges of the respective full engagement surfaces.

6. The load-bearing platform of claim 1 further comprising at least four quarter engagement surfaces, each quarter engagement surface defining an area of approximately (0.25) ·A $cm^2$, and wherein the edges of the top plate define a substantially square shape.

7. The load-bearing platform of claim 1 wherein the plurality of interior wall structures further comprises a plurality of channels defined by channel wall structures oriented orthogonally from a lower surface of the top plate, wherein each channel wall structure extends from a respective area along the lower surface of the top plate within which one of the respective apertures is located, thereby providing a path for fluid to migrate from the upper surfaces of the indentations to locations below the load-bearing platform.

8. The load-bearing platform of claim 7 wherein the channels comprise a substantially cylindrical shape.

9. The load-bearing platform of claim 7 wherein the first sidewall, the second sidewall, the third sidewall, and the fourth sidewall each further comprises six substantially planar sub-wall portions, and wherein each adjacent pair of sub-wall portions are oriented at an interior angle ranging from about 135 degrees to about 270 degrees.

10. The load-bearing platform of claim 9 wherein the plurality of interior wall structures further comprises at least four branch walls extending at approximately 0 degrees, 90 degrees, 180 degrees, and 270 degrees from each of the channel wall structures and extending to adjacent channel wall structures.

11. The load-bearing platform of claim 10 wherein the plurality of interior wall structures further comprises at least eight branch walls extending at approximately 0 degrees, 45 degrees, 90 degrees, 135 degrees, 180 degrees, 225 degrees, 270 degrees and 315 degrees from at least one of the channel wall structures and wherein the branch wall structures extending at approximately 45 degrees, 135 degrees, 225 degrees, and 315 degrees from the channel wall structures all extend to adjacent channel wall structures.

12. The load-bearing platform of claim 1 further comprising a support pad including a base and a groove defined between a pair of pad sections, the pad removably attached along one of the interior wall structures, wherein the groove is defined orthogonal to the base whereby the pad can be removably engaged along the bottom of a load bearing platform by pressing a first side of the pad that includes the groove against an interior wall structure of the load-bearing platform such that the interior wall is jammed between the pair of pad sections.

13. The load-bearing platform of claim 1 wherein the first female attachment device further comprises an elongate slot extending from a bottom edge of the third sidewall to from about 20% to about 80% the height of the third sidewall.

14. The load-bearing platform of claim 1 wherein the first female attachment device further comprises a vertically oriented narrow appendage including a cap extending orthogonal from a distal end of the appendage, wherein the appendage extends outward from a bottom edge of the first sidewall to from about 20% to about 80% the height of the first sidewall.

15. The load-bearing platform of claim 3 wherein the at least five full engagement surfaces comprise square shapes and wherein the outer edges of the engagement surfaces are oriented substantially parallel to each other, thereby defining a crisscross pattern of bar shaped sections along the top plate.

16. The load-bearing platform of claim 15 wherein the upper surfaces of the bar shaped sections have the appearance of a surface consisting essentially of a member selected from the group consisting of concrete, brick, rock, and sand.

* * * * *